US005674133A

United States Patent [19]

Chang et al.

[11] Patent Number: 5,674,133

[45] Date of Patent: Oct. 7, 1997

[54] STRUCTURE OF GOLF CLUB HEAD

[75] Inventors: Poh-Heng Chang, Melaka, Malaysia; Chung-Jong Sung, Tainan, Taiwan

[73] Assignee: Sung Ling Golf & Casting Co., Ltd., Tainan, Taiwan

[21] Appl. No.: 660,926

[22] Filed: Jun. 10, 1996

[51] Int. Cl.[6] ..... A63B 53/04

[52] U.S. Cl. ..... 473/291; 473/350

[58] Field of Search ..... 473/349, 350, 473/291, 290

[56] References Cited

U.S. PATENT DOCUMENTS

| | | | |
|---|---|---|---|
| 2,846,228 | 8/1958 | Reach | 473/350 X |
| 4,355,808 | 10/1982 | Jernigan et al. | 473/350 X |
| 4,715,601 | 12/1987 | Lamanna | 473/409 |
| 4,957,294 | 9/1990 | Long | 473/350 |
| 5,242,167 | 9/1993 | Antonious | 473/350 |

*Primary Examiner*—George J. Marlo
*Attorney, Agent, or Firm*—Varndell Legal Group

[57] ABSTRACT

A golf club head which has a face panel of uniform thickness, a back defining a hollow space and a space for counterweight, a flange raised from the back and having two different thicknesses respectively surrounding the hollow space and the space for counterweight, a counterweight mounted in the space for counterweight, and a shock absorbing material filled in the hollow space an covered over the counterweight, wherein the location of the counterweight is visually recognized through the thickness difference of the flange.

7 Claims, 9 Drawing Sheets

STRUCTURE OF GOLF CLUB HEAD

BACKGROUND OF THE INVENTION

The present invention relates to an improved structure of golf club head which provides an indication that shows the location of the center of gravity and, which effectively absorbs shock waves.

According to the present invention, the golf club head comprises a face panel of uniform thickness, a flange raised around the border of the back side of the face panel and having a thickness difference which shows the location of the center of gravity of the club head, and a shock-absorbing material stuffed in the recessed area defined within the flange and adapted for absorbing shock waves.

BRIEF DESCRIPTION OF THE DRAWINGS

The present invention will now be described by way of example with reference to the annexed drawings in which.

DETAILED DESCRIPTION OF THE PREFERRED EMBODIMENT

If to achieve a good striking while playing the game of golf, the center of gravity of the face panel 13 (see FIG. 6A, FIG. 6B) must positively strike the ball. However, the impact of the striking will cause the golf club head to produce a torsional force, and the shock waves tend to be transmitted to the player's arms, causing the player's arms to be injured. In order to let the striking function of a golf club head be fully carried out and to prevent the transmission of torsional force to the arms, it is desirable to prominently mark out the sweet spot of the face panel and to stuff the inside of the back side of the golf club head with shock absorbing material.

Figure 3:
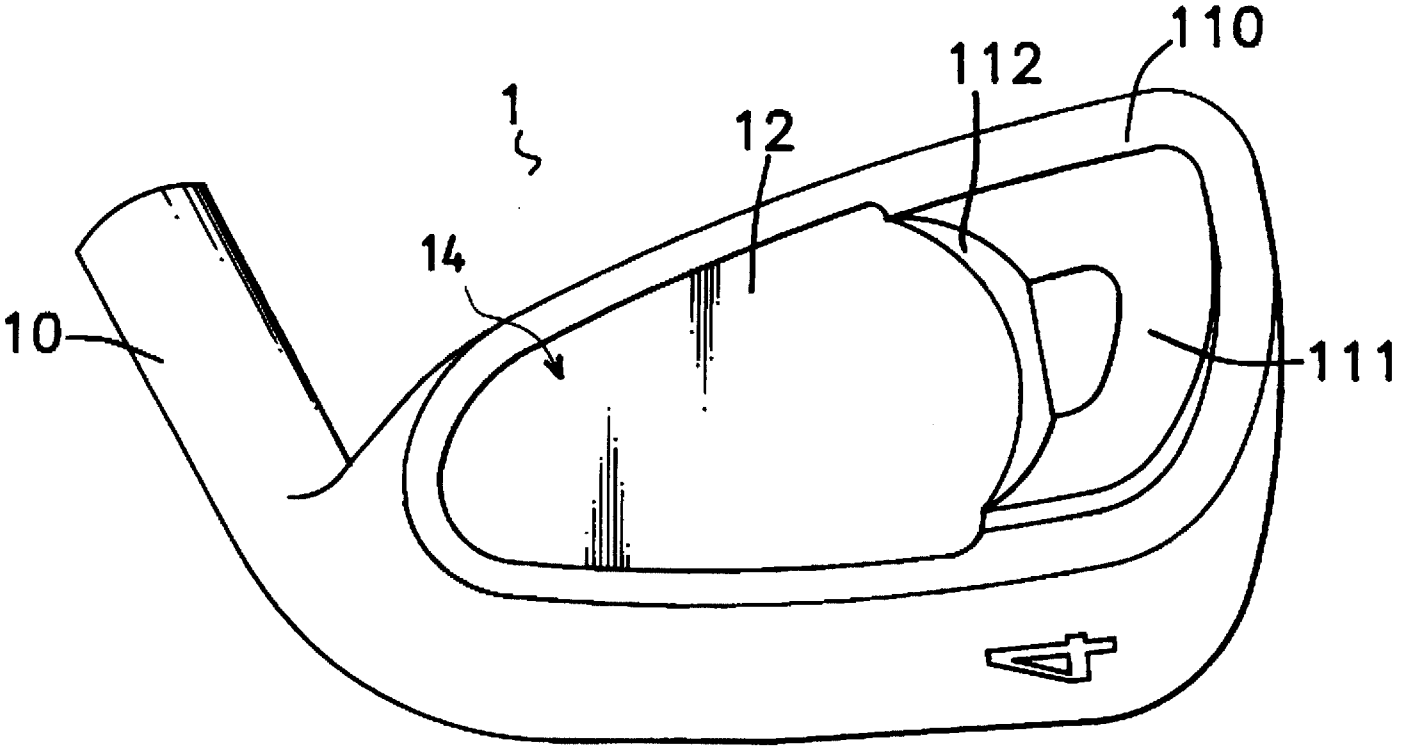
FIG. 3 shows the structure of the blank of a golf club head for a No. 4 iron cast according to the present invention.

Referring to FIG. 3, the structure of the golf club head I includes three parts, namely, the neck 10, the face panel 13 (see FIG. 6A, FIG. 6B) and the back 14. The neck 10 is adapted for coupling to the shaft. The face panel 13 has a uniform thickness which provides the golf club head with a broad sweet spot. The back 14 provides a particular space for a counterweight 111. The counterweight 111 is mounted in the back 14 at a particular location subject to the number (left) of the golf club. A flange 110 is raised around the border of the back 14. Because of the formation of the flange 110, the back 14 is presented in a recessed structure. The thickness of the flange 110 is uneven so that the location of the counterweight 111 can be quickly found by viewing the difference in thickness from the flange 110. Rubber, resin, or suitable shock absorbing materials are stuffed or secured in the back 14 within the flange 110 to form a shock absorbing area 113 (see FIG. 6, FIG. 7, FIG. 8).

Figure 1:
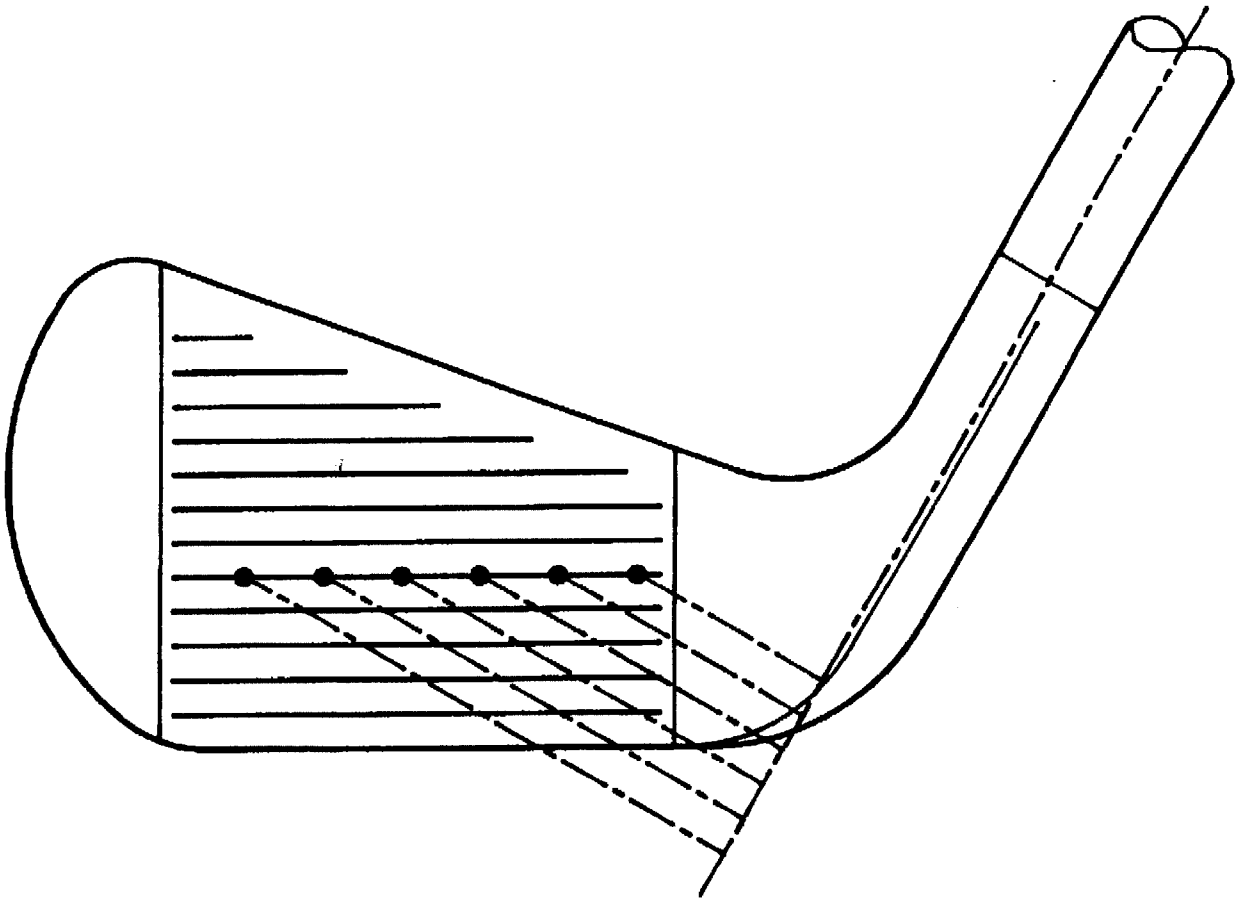
FIG. 1 is a schematic drawing of a golf club head, showing different arms of force at different points on the face panel.
Figure 2:
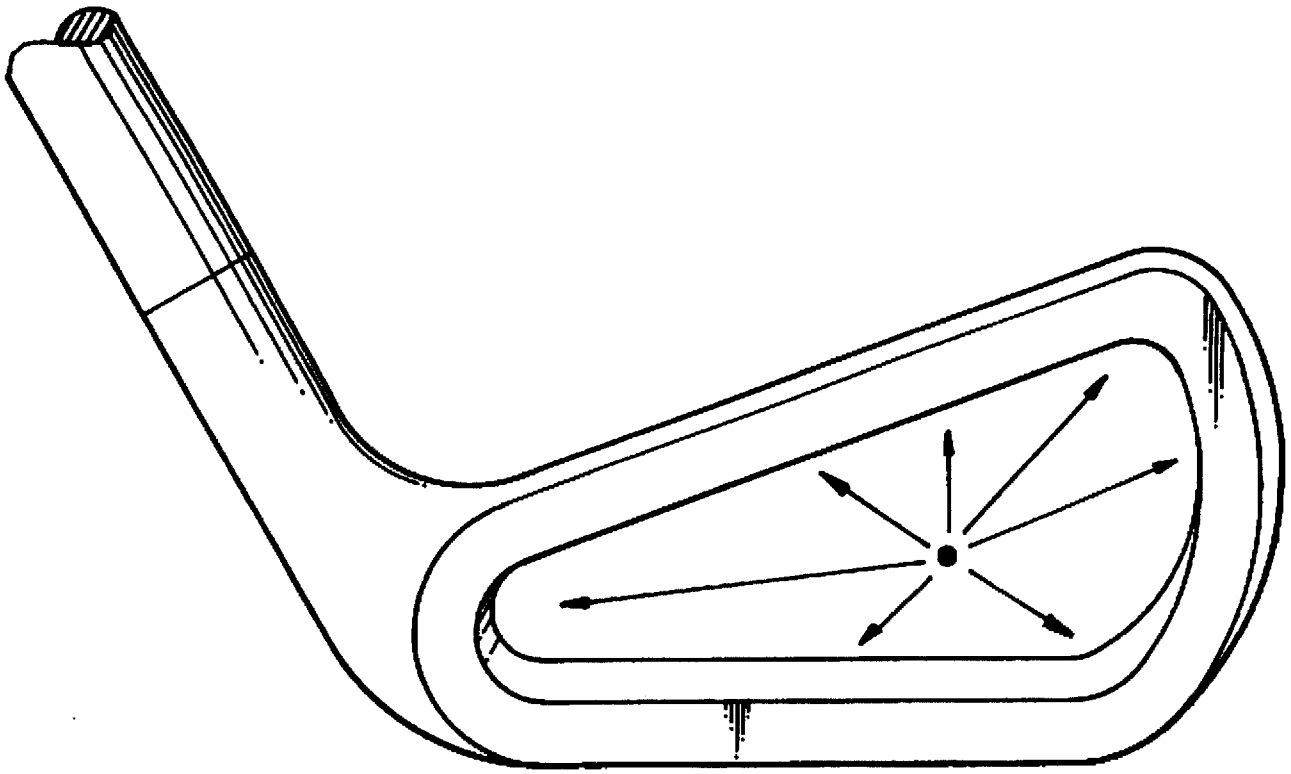
FIG. 2 shows different transmission directions of impact force from the striking point.
Figure 4:
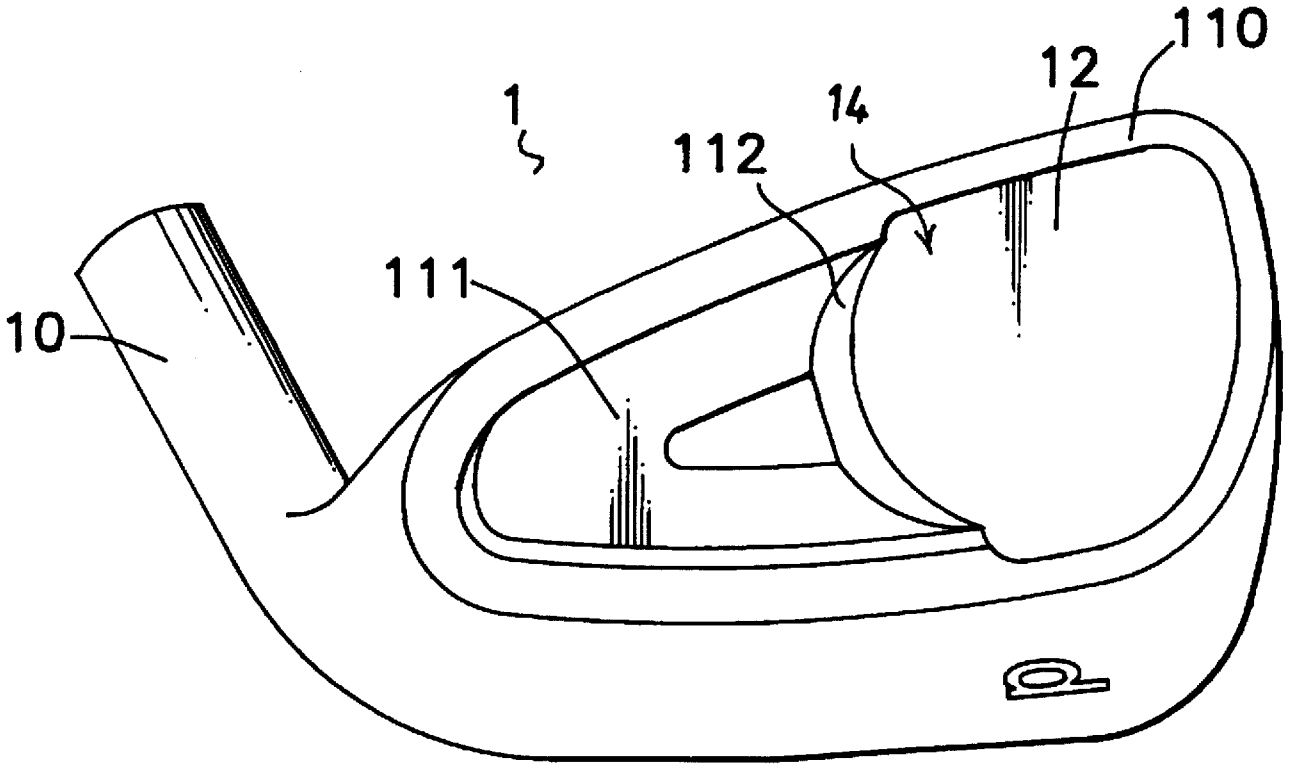
FIG. 4 shows the structure of the blank of a golf club head cast according to the present invention, which has a "P" thereon representing a pitching iron.
Figure 5:
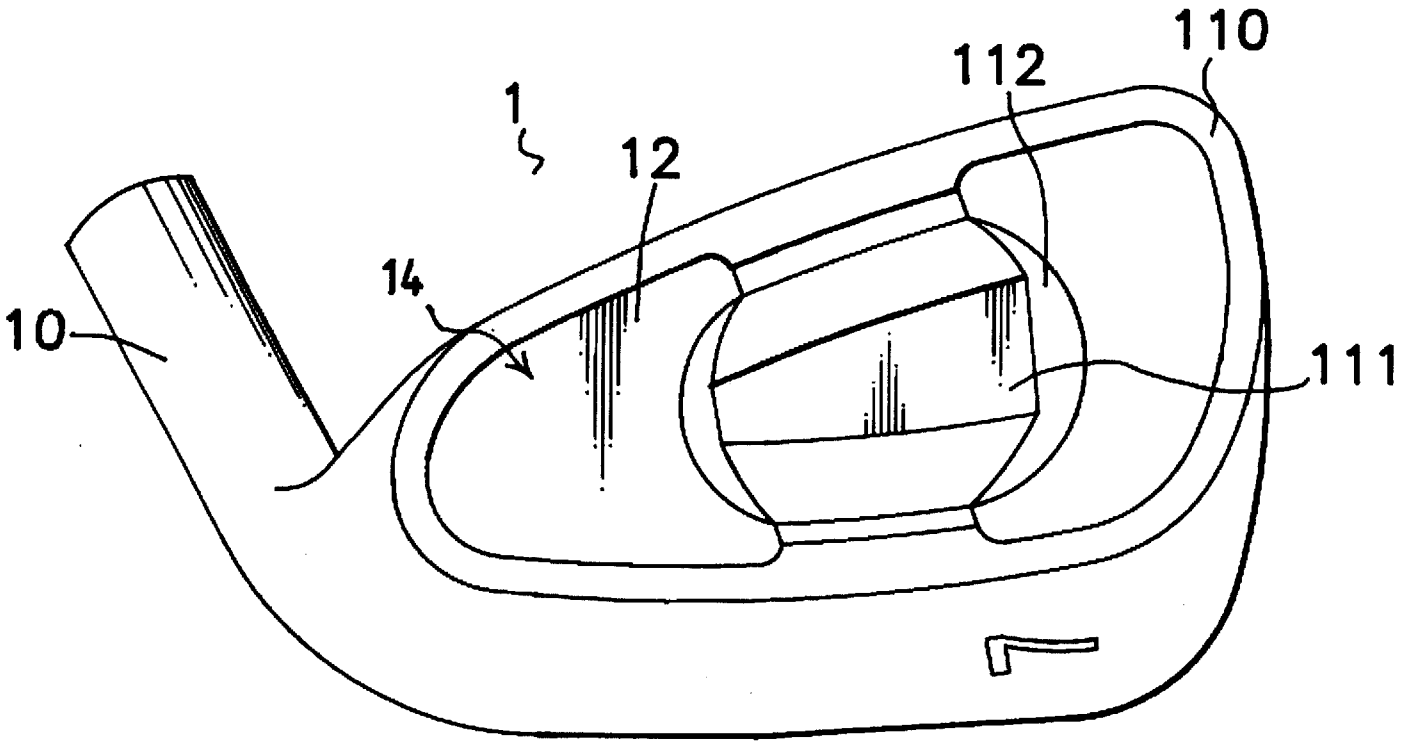
FIG. 5 shows the structure of the blank of a golf club head for a No. 7 iron cast according to the present invention.
Figure 6:
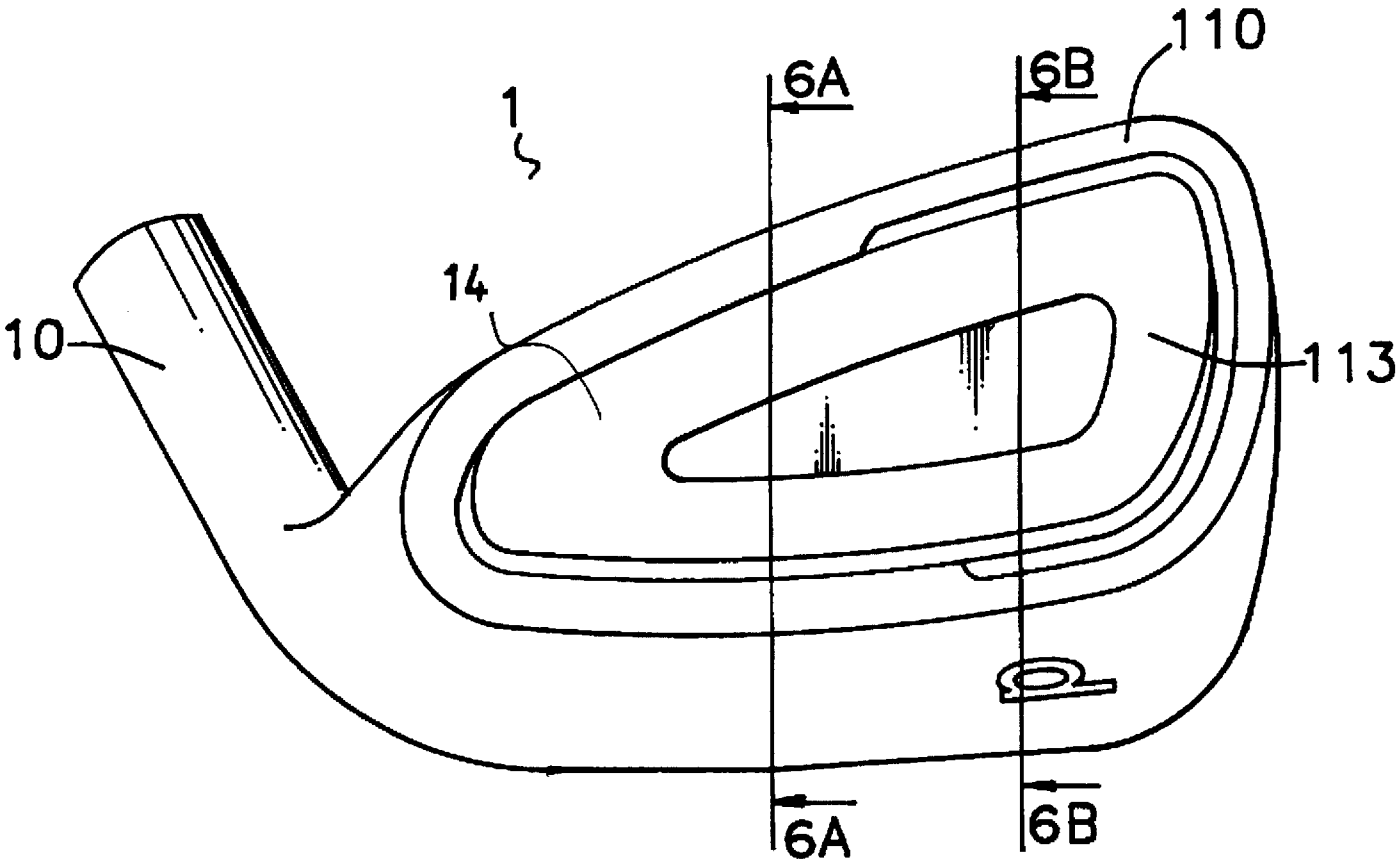
FIG. 6 shows the structure of a finished golf club head according to the present invention.
Figure 6B:
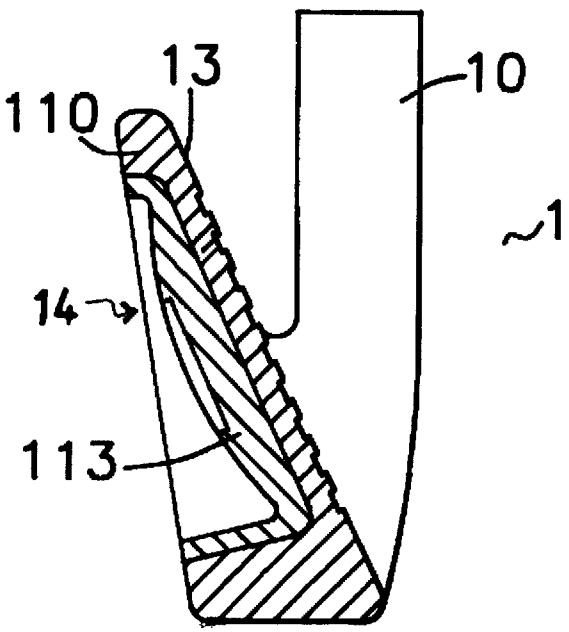
FIG. 6B is a sectional view taken along line 6B—6B of FIG. 6.
Figure 6A:
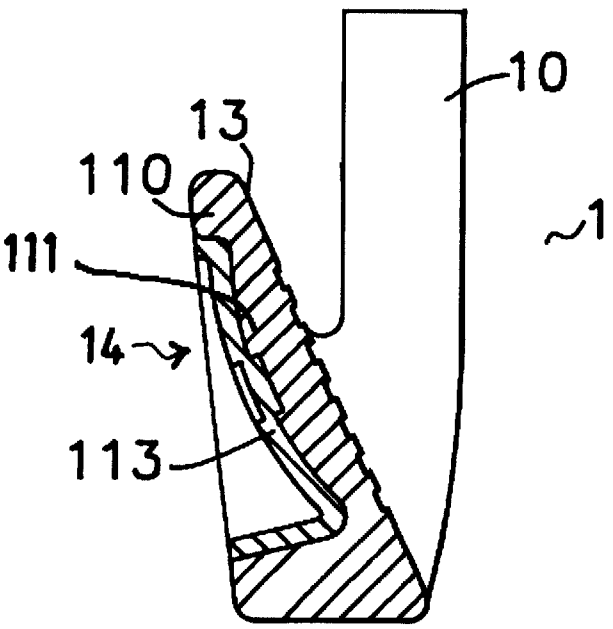
FIG. 6A is a sectional view taken along line 6A—6A of FIG. 6.

Referring to FIG. 1, when the center of gravity of the golf club head is changed, the arm of force (perpendicularly connected from the center of gravity to the longitudinal axis of the shaft) is relatively changed. When the golf club head strikes the ball, a torsional force and shock waves are produced along the arm of force. FIG. 2 shows shock waves transmitted radially from the inside of the golf club head to the border area. In order to enable the whole area of the face panel 13 to strike the ball efficiently, the thickness of the face panel 13 is made uniform. The location of the counterweight 111 in the back 14 of the golf club head 1 is determined relative to the number of the golf club, and is disposed closer to the neck 10 in the order from lower number to the higher number, i.e., for a higher number of golf club, the counterweight 111 is disposed in the back 14 of the golf club head I closer to the neck 10. The counterweight 111 may be integrally cast with the golf club head 1, or separately made and then welded to the golf club head 1. The flange 110 is raised around the border of the back 14 of the golf club head 1, defining a hollow space 12 and a space for the counterweight 111, having for example two different thicknesses respectively surrounding the hollow space 12 and the space for the counterweight 111. Through the thickness difference of the flange 110, the location of the counterweight 111 is quickly recognized. Furthermore, the periphery of the golf club head 1 is molded with a type corresponding to the number of the golf club, which type is formed during the casting of the golf club head 1. When the golf club head 1 is cast, it must be polished, and the face panel 13 of the golf club head 1 must be processed by a sand blasting machine to provide a sand blast finish which achieves a relatively higher coefficient of friction. Therefore, when the face panel 13 strikes the ball, the ball will be driven outwards along the curvature of the striking of the golf club. On the contrary, if the face panel 13 has a smooth surface of relatively lower coefficient of friction, the ball may slide from the striking point upon its contact with the face panel 13, causing the ball to deviate from the scheduled course. When the blank of the golf club head 1 is cast, the connecting area between the hollow space 12 and the counterweight 111 must be well processed. If the gradient between the hollow space 12 and the counterweight 111 is sharp, a fault will occur when shock absorbing material such as rubber or resin is filled in the hollow space 12 and covered over the counterweight 111. Although the shock absorbing material has a uniform contraction percentage, the fault will still occur if there is a sharp gradient between the hollow space 12 and the counterweight 111, because the sock absorbing material is filled in the hollow space 12 and covered over the counterweight 111 in a semi-liquid form. In order to prevent the occurrence of this problem, the gradient between the hollow space 12 and the counterweight 111 must be smoothened. The border area of the hollow space 12 is gradually raised toward the border area of the counterweight 111, i.e., a slope 112 is formed between the hollow space 12 and the counterweight 111. When the shock absorbing material is filled in the back 14, it is bounded to the surface of the back 14, and molded in the desired shape. From FIG. 3, FIG. 4, and FIG. 5, the location of the counterweight 111 can be quickly recognized by means of visually checking the thickness change of the flange 110. FIG. 6A and FIG. 6B are sectional views respectively taken along line 6A—6A and line 6B—6B of FIG. 6, showing the cross section of the counterweight 111 and the cross section of the hollow space 12. As illustrated, the layer of the shock absorbing material which covers over the counterweight 111 is relatively thinner than that of the shock absorbing material which covers over the hollow space 12. If there is no slope 112 between the hollow space 12 and the counterweight 111, the amount of contraction of the shock absorbing material in the area above the hollow space 12 will be relatively higher than that above the counterweight 111, causing a break in the continuity of the layer of the shock absorbing material, and the surface of the shock absorbing material will not be maintained in a flush manner. FIG. 6 shows the golf club head 1 finished. When the golf club head 1 is finished, it may be electroplated or gold plated so as to increase its value.

Figure 7:
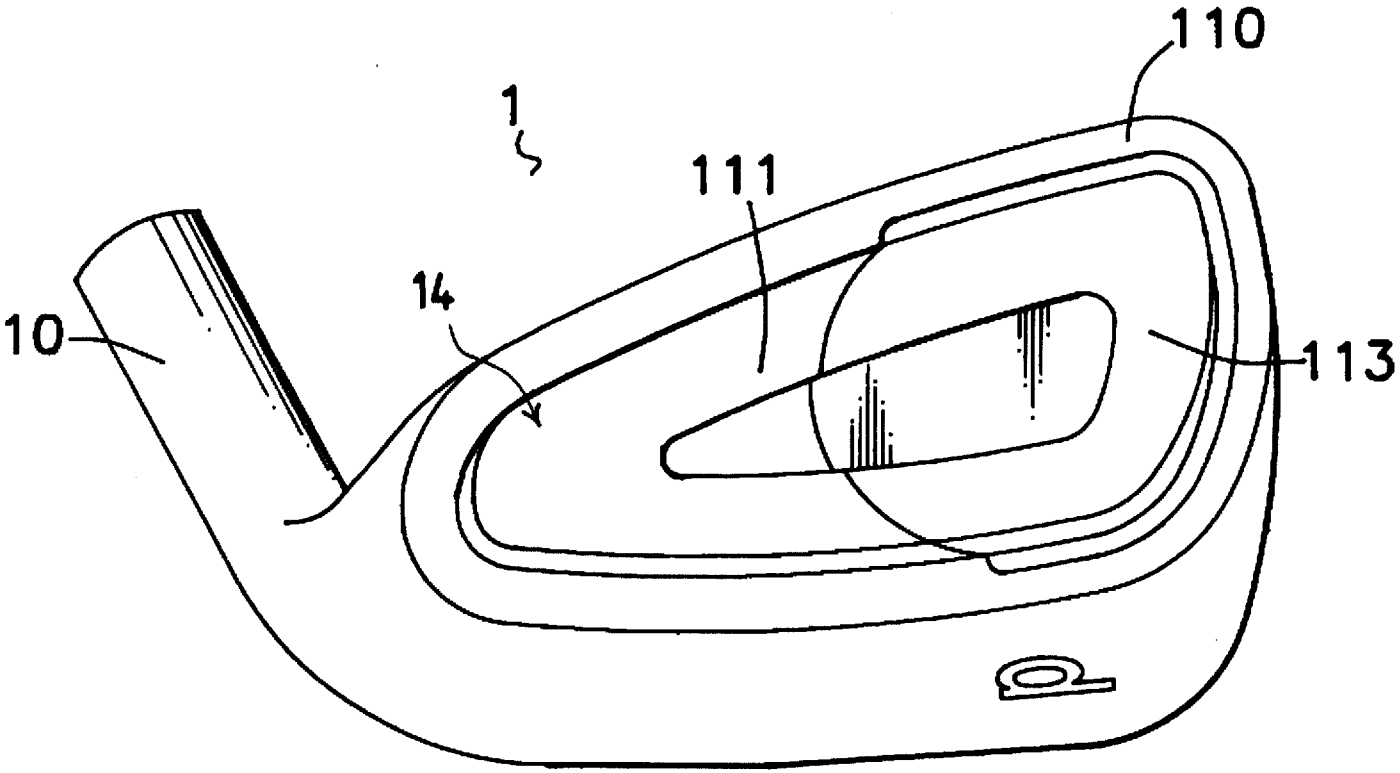
FIG. 7 shows an alternate form of the golf club head according to the present invention.
Figure 8:
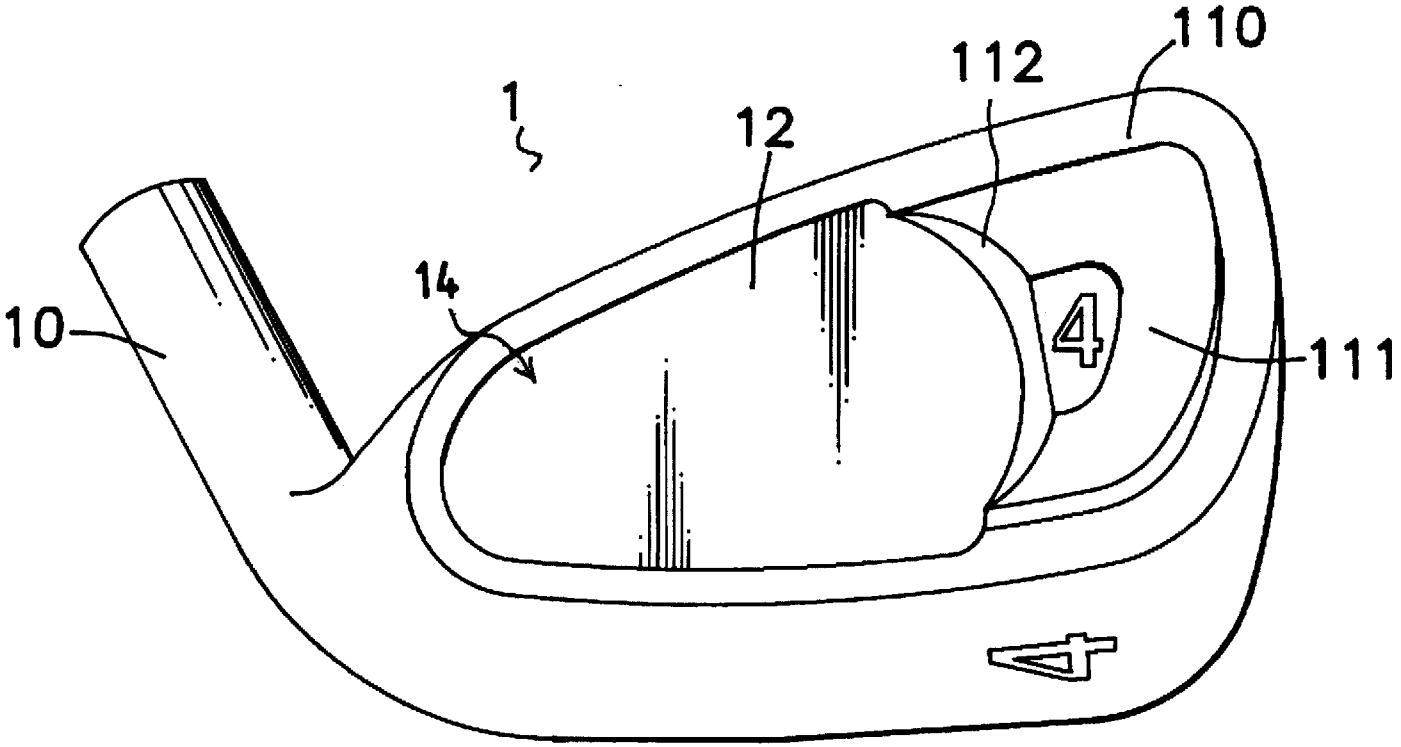
FIG. 8 shows another alternate form of the golf club head according to the present invention.

FIGS. 7 and 8 show two different alternate forms of the present invention. In FIG. 7, the outside surface of the counterweight 111 is disposed in flush with the outside surface of the shock absorbing material. In FIG. 8, the shock absorbing material is transparent, and covers over the counterweight 111; the counterweight 111 is marked with a number corresponding to the number of the golf club, which number can be viewed from the outside through the transparent shock absorbing material.

I claim:

1. A set of golf club heads, each said head having a top, a bottom, a first end, a second end having a neck adapted for receiving a shaft, a front with a face plate, a back including a counterweight, and a shock absorbing material, said face plate has a uniform thickness, said back has a periphery and a flange raised around said periphery defining a hollow cavity in said back; said flange has a circumference extending around said periphery, a height extending backward from said face plate, and a thickness perpendicular to said circumference and said height; said thickness of said flange includes a thicker portion and a thinner portion in a direction along said circumference, said thicker portion having a greater thickness than said thinner portion, said thinner portion of said thickness of said flange extending from said top to said bottom and along one of said first and second ends of said golf club head, said flange includes said thicker portion of said thickness along said top and said bottom of said golf club head, said counterweight is integrally formed with said face plate and forms a smooth slope therewith in said back, said slope extending from a bottom of said hollow cavity to a top of said counterweight, and said shock absorbing material is mounted on said back and fills in said hollow cavity.

2. The set of golf club heads of claim 1, wherein each said golf club head has a different number and a different location of said counterweight in said back relative to said neck based on the number of the golf club head, so that a distance between said counterweight and said neck is relatively shortened from a lower numbered head to a higher numbered head.

3. The set golf club heads of claim 1, wherein said slope has a gradient gradually increasing backward from said face plate to said counterweight.

4. The set golf club heads of claim 1, wherein said shock absorbing material is bound to said back and has an outside surface molded in a predetermined shape.

5. The set of golf club heads of claim 1, wherein said shock absorbing material is disposed in flush with said counterweight.

6. The set golf club heads of claim 1, wherein each said golf club head has a different number marked on said counterweight, said shock absorbing material is transparent and covers said number marked on said counterweight.

7. The set golf club heads of claim 1, wherein said thicker portion of said thickness is arranged in said circumference adjacent said counterweight.

* * * * *